United States Patent [19]

Jeziorowski

[11] Patent Number: 4,859,010

[45] Date of Patent: Aug. 22, 1989

[54] REFRIGERATOR DOOR TRAY ASSEMBLY

[75] Inventor: Les A. Jeziorowski, Ancaster, Canada

[73] Assignee: CAMCO Inc., Mississauga, Canada

[21] Appl. No.: 300,886

[22] Filed: Jan. 24, 1989

[30] Foreign Application Priority Data

Mar. 10, 1988 [CA] Canada ..... 561118

[51] Int. Cl.[4] ..... A47B 51/00

[52] U.S. Cl. ..... 312/312; 312/242; 312/138.1

[58] Field of Search ..... 108/109; 211/88, 187, 211/191, 193; 248/239; 312/245, 247, 138 R, 214, 270, 298, 236, 306, 246, 242, 312

[56] References Cited

U.S. PATENT DOCUMENTS

| | | | |
|---|---|---|---|
| 2,852,328 | 9/1958 | Jewell et al. | 312/138 AX |
| 3,156,509 | 10/1964 | Padgett | 312/214 |
| 3,227,502 | 1/1966 | Roberts | 312/214 |
| 3,610,174 | 10/1971 | Kesling et al. | 108/146 |
| 3,652,032 | 3/1972 | Eros et al. | 248/235 |
| 3,807,822 | 4/1974 | Amore | 312/138 A |
| 4,534,530 | 8/1985 | Danko | 248/239 |
| 4,542,831 | 9/1985 | Dazza | 312/245 X |

FOREIGN PATENT DOCUMENTS

| | | | |
|---|---|---|---|
| 631401 | 11/1961 | Canada . | |
| 848840 | 8/1970 | Canada . | |
| 1004278 | 1/1977 | Canada . | |
| 851667 | 10/1980 | United Kingdom | 312/138 A |

*Primary Examiner*—Joseph Falk

*Attorney, Agent, or Firm*—Raymond A. Eckersley

[57] ABSTRACT

A refrigerator door tray assembly includes a refrigerator door with an inner liner having a cavity defined by a rear wall and two forwardly projecting supporting side walls. Each of the side walls includes an inwardly projecting shoulder having an upwardly facing ledge that slopes downwardly toward the rear wall at a predetermined angle. A tray is provided for insertion into the cavity between the side walls. The tray comprises upstanding walls each having an outwardly extending arm. The arm has a downwardly facing surface that slopes downwardly at the predetermined angle such that the downwardly facing surface of the arm is adapted to at least partially engage the ledge during insertion and lie flush on the ledge once inserted into the cavity. The tray further includes laterally extending flanges adapted to engage the ends of the supporting side walls so as to cooperate with the arms and ledges to positively locate the tray in the door cavity. The flanges help to locate the bin above the shoulders in the door liner so that the tray can move downwardly into engagement with the shoulders to positively locate the tray in the cavity.

9 Claims, 5 Drawing Sheets

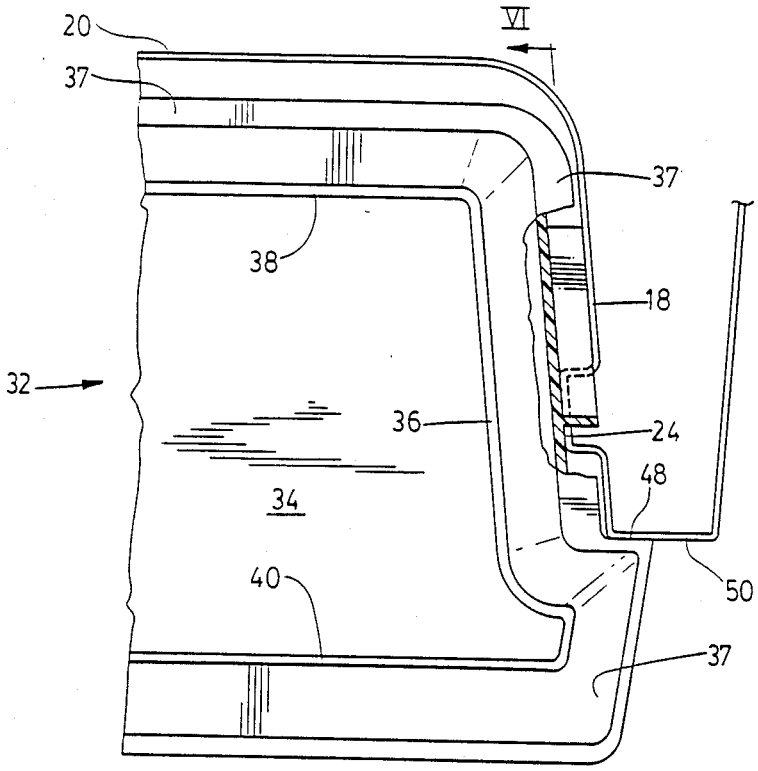
FIG. 5
VI
FIG. 6
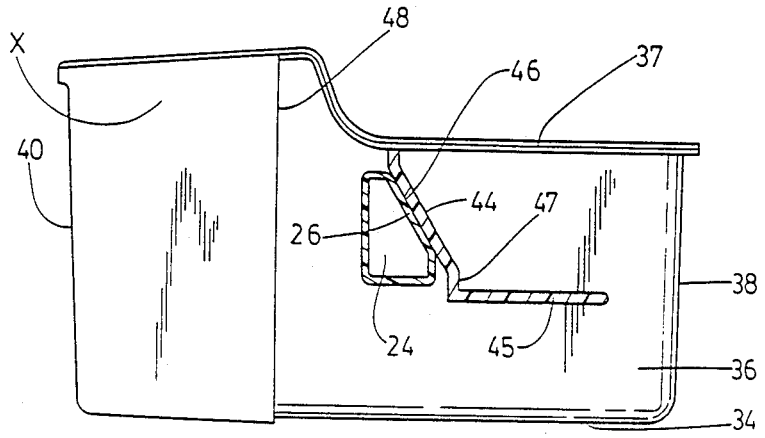

REFRIGERATOR DOOR TRAY ASSEMBLY

The present invention relates to a refrigerator door tray assembly. More particularly, it relates to a tray that is adapted to slide into a cavity defined by the inner liner of the refrigerator door.

It is common to provide the inner liner of the refrigerator door with a plurality of adjustable shelves. The shelves are usually provided with male tab members having a hook shape which are inserted into openings between rungs of a ladder type bracket fastened to the liner. The hook-like tab members cause the shelves to be supported from the brackets in a cantilever fashion that tends to result in the shelves being wedged in position making this type of adjustable shelving cumbersome to use as it usually requires two hands to remove the shelf and reposition it within the cavity of the liner. Further, the use of this type of ladder bracket adds cost to the refrigerator.

Canadian Pat. No. 631,401, issued Nov. 21, 1961 to Whirlpool Corporation provides a boss that projects inwardly from the side walls of the door liner. A shelf is provided that has a hook-like upper part which wraps around the boss. The shelf further includes a lip extending along the floor of the shelf that is inserted into the rear wall of the liner. The lip and hook of the shelf cooperate with the bosses and rear wall of the liner to support the shelf within the cavity. Again, such an arrangement does not allow for the easy insertion and removal of the shelf into the cavity of the door liner.

Another type of refrigerator door tray assembly is disclosed in Canadian Pat. No. 979,964 which issued Dec. 16, 1975 to Aeronutronic Ford Corporation. The trays of this assembly may be inserted into the cavity of the door liner defined between side walls of the door liner. The side walls of the door liner are provided with indentations in the liner into which a plunger structure associated with the tray may be inserted. The tray further includes flanges which surround the ends of the forwardly projecting wall of the door liner. These trays are of complex structure which do not lend themselves to simple removal from the cavity in the door liner and add cost of the refrigerator.

While simplified refrigerator door shelf assemblies are available, these assemblies have disadvantages associated with them in that either the shelf tends to become wedged in the door liner cavity making its removal rather cumbersome or the shelf is not properly secured within the cavity causing it to be displaced from the door cavity liner upon forceful closure of the door. One such assembly comprises a door liner having elongated horizontally extending rails projecting from the side walls of the liner. The assembly further includes a tray having a floor adapted to rest on the rails. These rails are provided with a hook at their ends which fits into a corresponding recess portion in floor of the tray so as to prevent the tray from slipping out of the door liner. While such a door liner provides for relatively easy insertion and removal of the tray from the door, the tray tends to be dislodged from the cavity when door is forcefully closed.

Another door tray assembly currently in use has a door tray having a recess member in its side wall which sits over a circular post projecting from the door liner into the cavity. The tray is held on the circular post like projections by a button pressed out from a vertical recessed groove in the side wall of the tray. The button provides an interference fit with the end of the post to secure the door to the posts within the cavity of the liner. The tray is also provided with a flange which engages the other edge of the wall of the door liner only for the purpose of preventing tipping. To effect removal of the tray from the door, considerable force must be applied with both hands in the vertical direction since the tray is held by means of interference in the door liner. This removal is cumbersome and could result in food spillage from the tray during tray removal.

It is therefore an object of the present invention to provide a refrigerator door tray assembly wherein a tray may be readily inserted and removed from the door without the use of brackets that have to be secured to the liner.

It is a further object of the present invention to provide a refrigerator door tray assembly in which the tray may be readily inserted and removed from the door but will be positively located within the door such that it will not be dislodged upon forceful closing of the door.

It is a further object of the present invention to provide a refrigerator door tray assembly which may be moved within the cavity to facilitate tray loading.

According to one aspect of the present invention, there is provided a refrigerator door tray assembly including a refrigerator door comprising an inner liner having a cavity defined by a rear wall and two forwardly projecting supporting side walls. Each of the supporting side walls includes opposing tray support means which project from the side walls into the cavity. The tray support means have an upwardly facing ledge that slopes downwardly toward the rear wall at a predetermined angle. The assembly further includes a tray positionable within the cavity of the refrigerator door. The tray includes a floor having two upstanding side walls located adjacent the support walls of the liner. The side walls of the tray each include outwardly projecting arm means including a downwardly facing surface that slopes downwardly at the predetermined angle such that the arm means is adapted to lie flush on the ledge of the support means. The tray further includes positioning means for engaging the inner liner to limit movement of the tray into the cavity. The positioning means cooperates with the downwardly facing surface of the arm means and the ledge of the support means to positively locate the tray in the cavity.

By providing an arm that slopes on the tray at a predetermined angle equal to the sloping ledge of the support means of the side wall, an effective mechanism is provided for readily inserting the tray into the cavity of the door liner without wedging the tray in the cavity. The tray may be readily inserted by sliding the arm means along the ledge as the tray is inserted into the cavity until the positioning means limits movement of the tray into the cavity. Alternatively, the tray may be secured in the cavity by inserting the tray into the cavity above the ledge until the positioning means limits travel of the tray into the cavity and subsequently lowering the tray onto the ledge. Further, the assembly of the present invention does not require any further external members which have to be secured to the liner such as a ladder type of supporting bracket.

The positioning means may comprise flanges which project laterally from the tray to engage ends of the side walls. These flanges may be formed in the side walls of the tray. The purpose of the flanges is to positively locate and to limit travel of the tray in the cavity. The flanges cooperate with the sloping surface of the arm of the tray and the sloping ledge of the support means to positively locate the tray in the cavity. The flush engagement is essential to the present invention since a securing effect is provided that evenly distributes the weight of the tray over the length of the sloping surfaces. This securing effect is different from that provided by the prior art which commonly has an uneven weight distributed point-to-point contact or wedging effect.

The tray may be further provided with an upstanding rear wall and a lip which extends around the side walls and the rear wall towards corresponding side and rear walls of the liner. The lip further acts to positively locate the tray within the cavity and eliminate any excess space between the liner walls and the tray. This allows for a more aesthetic fit between the tray and the liner walls. It should be understood that it is envisaged that the lip may form the positioning means in one embodiment of the present invention without requiring lateral flanges formed on the tray.

The projecting arm means of the present invention may further include a securing arm portion extending vertically downward from the downwardly facing surface of the arm means and a leading arm portion extending horizontally from the securing arm portion. The securing arm portion may co-operate with the downward facing surface of the arm means during insertion of the tray into the cavity and prevent the removal of the tray from the cavity once inserted.

It should be understood that the predetermined angle should be sufficient to allow the tray to be positively held within the door cavity such that forceful closing of the door would not result in the tray being dislodged while at the same time the angle will provide proper support for the weight of the food articles in the tray without resulting in the tray being wedged in the cavity. Accordingly, the tray can be readily inserted and removed from the door liner due to the even weight distribution of the arm of the tray over the ledge of the side walls which allows for a sliding engagement without wedging.

For better understanding of the nature and objects of the present invention, reference may be had to the following diagrammatical drawings in which:

FIG. 5 is plan view showing the tray positively located by the side walls of the inner liner within the cavity;

FIG. 6 is a view of the tray and support means taken along line VI—VI of FIG. 5;

Figure 1:
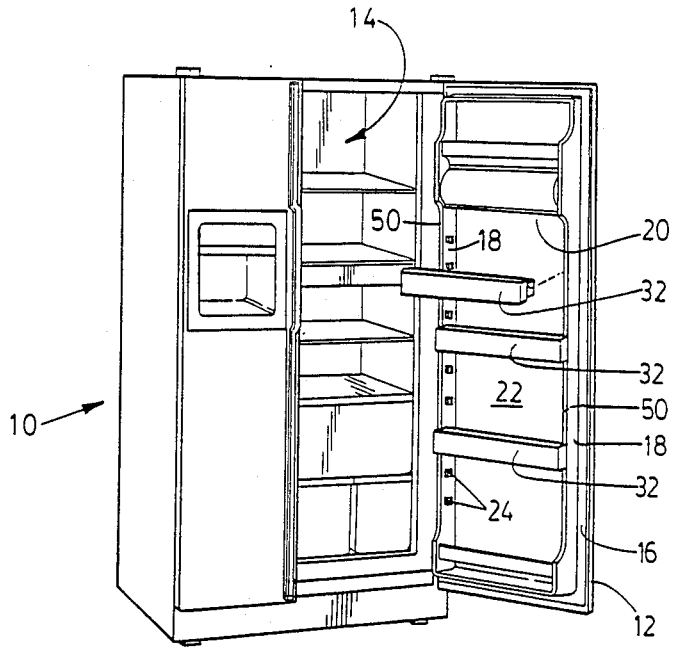
FIG. 1 is a perspective view of a refrigerator showing the refrigerator door tray assembly of the present invention.
Figure 2:
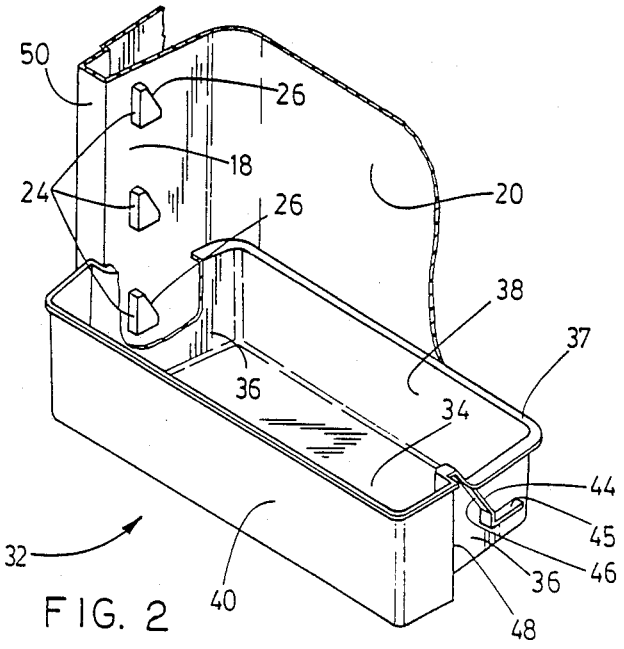
FIG. 2 is and enlarged view showing the tray and door liner of the assembly of the present invention.
Figure 3:
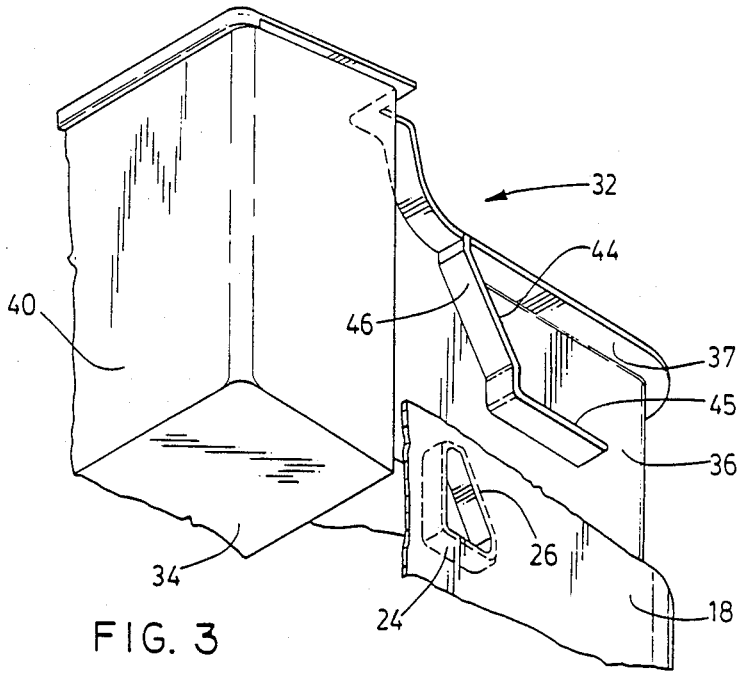
FIG. 3 is an enlarged perspective view of showing the tray being positioned adjacent one side wall of the inner liner.
Figure 4:
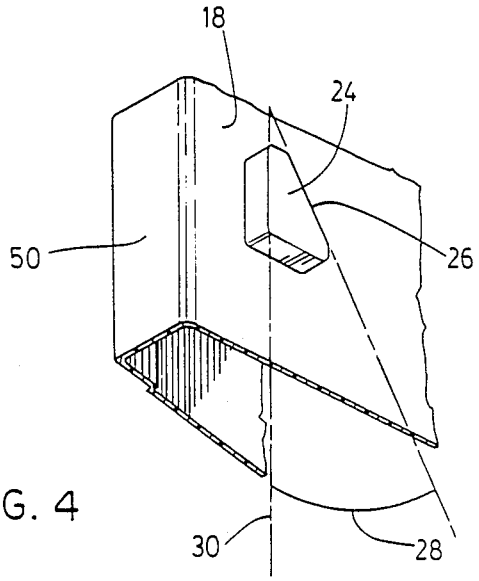
FIG. 4 is a partial view of one side wall of the inner liner showing the support shoulder of the present invention.

Referring to FIGS. 1 and 2, there is shown a refrigerator 10 having a door 12 adapted to open and close a compartment 14 of the refrigerator. The door 12 is provided with an inner liner 16. The liner 16 includes supporting side walls 18 which extend forwardly of a rear wall 20 to define a cavity 22 therebetween. The side walls 18 of the liner 16 are provided with a plurality of shoulders 24 projecting from the side walls 18 into cavity 22. The shoulders 24 constitute the support means of the present invention. The shoulders 24 are each provided with an upwardly facing ledge 26. The ledge 26 slopes downwardly towards the rear wall 20 of the liner 16 at a predetermined angle. In FIG. 4, this angle is shown at 28 to be an acute angle with respect to vertical line 30. The acute angle 28 is preferably 30°. The door liner 16 is vacuum formed with the shoulders 24 formed therein. The shoulders 24 are shown to be spaced on each side wall in a vertical direction to permit a plurality of tray locations.

Each of the support means or shoulders 24 is adapted to support a tray 32. Referring to FIGS. 2, 3, 5 and 6, the tray 32 is provided with a floor 34, upstanding side walls 36, a rear wall 38, and a front wall 40. Skirting the upper portion of the side wall 36 and rear wall 38 is a lip 37 which extends towards adjacent side walls 18 and rear wall 20 of the door liner 16. The upstanding walls 36 of the door tray are provided with a support arm means or rib like member 44. Rib like member 44 has a downwardly facing surface 46 which slops at the same angle, acute angle 28, as the ledge surface 26 of shoulders 24. Rib member 44 includes a leading portion 45 that extends substantially horizontally and acts to guide the tray during insertion of the tray within the cavity. Interposed between the leading portion 45 and the downwardly facing surface 46 of the rib member 44 is a vertically extending securing arm portion 47. While portion 47 is preferred in this embodiment of the invention, it should be understood that securing arm portion 47 acts to further ensure that the tray is not forced from the cavity during forceful closing of the refrigerator door. The tray 32 further includes flanges 48 (see FIGS. 5 and 6) which are adapted to engage the ends 50 of the side walls 18 to limit the movement of the tray into the cavity and cause the rib arm portion 46 to lie flush on the ledge 26 of the shoulders 24.

Figure 7:
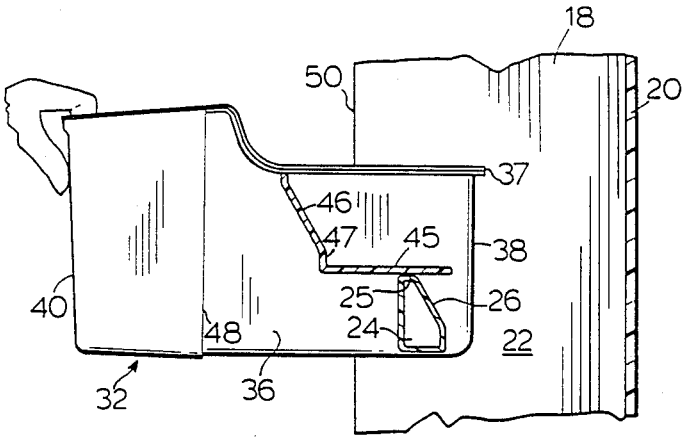
FIGS. 7 to 9 show one method of inserting the tray into the cavity.
Figure 8:
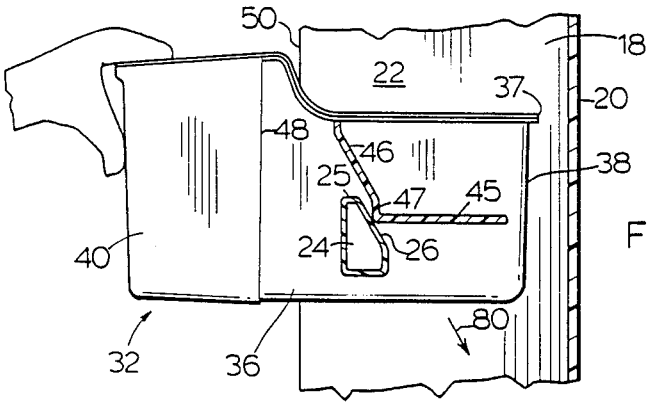
Figure 9:
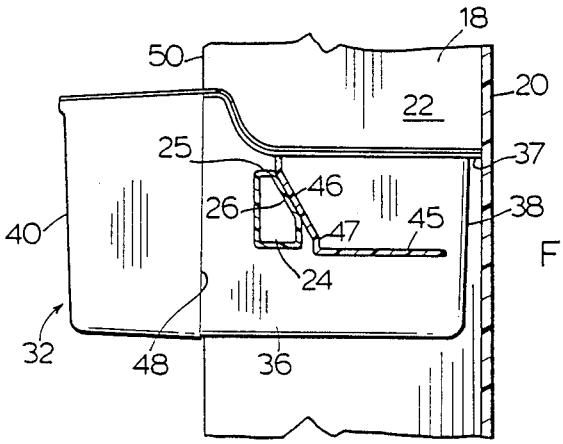

FIGS. 7 through 9 illustrate the most common method of inserting the tray 32 into the cavity 22 of the refrigerator door. The tray 32 is first positioned with the horizontal leading arm portion 45 located on the upper surface 25 of the shoulder 24 as shown in FIG. 7. The tray 32 may then be moved forward towards the rear wall 20 of the cavity. As the corner, where the horizontal portion 45 meets the securing vertical portion 47, moves over the edge 26, the tray 32 will fall due to gravity in the direction of arrow 80 (FIG. 8) which is more or less consistent with the angle 28 that the ledge 26 makes with the vertical plane. The tray 32 will continue to be lowered into the cavity until the flanges 48 on the tray engage the ends 50 of the side walls 22. At this point as shown in FIG. 9 the tray will be positively located within the cavity. It should be understood that the lip 37 of the tray 32 may be dimensioned with respect to the side walls 22 such that the lip also acts to locate the tray in the cavity on the shoulders 24. In the supported position shown in FIG. 9, the surface 46 of rib 44 lies flush against the upper surface 26 of shoulder 24 and the entire surface of flange 48 lies flush against the flat end wall surface 50. Due to the angle of the surfaces 26 and 46 the tray is positively located by the side walls 18 of the inner liner 16. It should be understood that the rib 44 or its leading portion 45 do not engage the rear wall 20 of the door liner 16.

Figure 10:
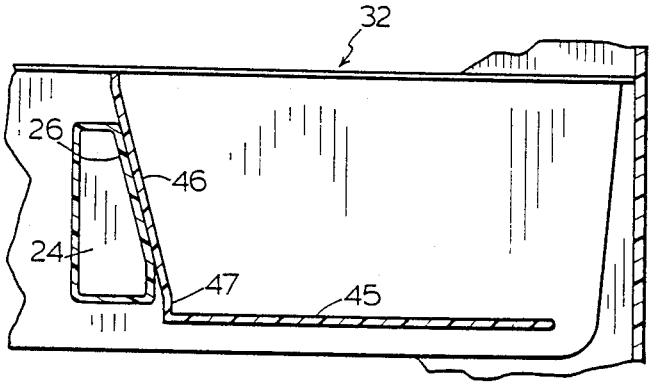
FIGS. 10 and 11 show extreme angles at which the leading edge of the slopes.
Figure 11:
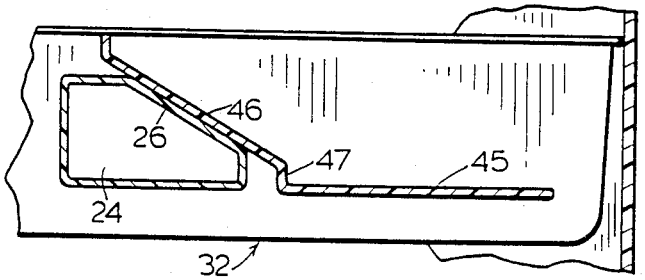

Referring to FIGS. 4, 10 and 11, the angle 28 should be sufficient to prevent the tray 32 from being displaced due to forceful closure of the door 12. The angle should also be sufficient to positively locate the tray in the cavity 22. For a tray adapted to take a load in the order of 9 to 10 pounds, the angle 28 is preferably 30°. The preferred operable range for this angle is from about 25° to 35°. However with the addition of the securing arm portion 47, the angle may be larger than degrees. FIG. 11 show an embodiment where the angle is less than 25°. From FIG. 11 it is apparent that the steep sloping ledge 26 would result in the tray wedging into the cavity and would also result in the tray being difficult to remove from the cavity. Clearly, the embodiment shown in FIG. 11 is illustrative of an extreme angle 28 and is not part of the present invention. In FIG. 12, the angle that the ledge slopes with respect to the vertical is greater than 35° and may be subject to the problem of the tray 32 being dislodged from the cavity during forceful closure of the door in the event arm portion 47 does not act as a stop.

It should be understood that the angle is determined by two factors. The first factor is the weight of the food in the tray. As the weight of the food in the tray increases, the angle required to maintain the tray in the cavity decreases because of the fact that the weight provides a greater downward force which acts to positively locate the tray in the door. The other critical factor in determining the angle is that, for a tray having no load or little or light load, the angle must be sufficiently small so as to prevent the door tray from being displaced as a result of forceful closure of the door.

What I claim as new and desires to secure by Letters Patent of the United States is:

1. A refrigerator door tray assembly including:

(a) a refrigerator door having an inner liner cavity defined by a rear wall and two forwardly projecting side walls, at least one pair of opposing tray support means projecting from said side walls, (b) each of said tray support means having a shoulder comprising an upper portion defining an upwardly facing ledge that slopes downwardly toward said inner liner rear wall at a predetermined angle and a lower portion defining a vertical edge in downward extension from said slope, (c) a tray positionable within the cavity of the refrigerator door, said tray including a bottom wall and two upstanding side walls positionable adjacent the side walls of the inner liner cavity, (d) each of the upstanding side walls of the tray having an outwardly projecting support arm including (i) a rib member having a bottom surface that slopes downwardly at said predetermined angle such that said bottom surface lies flush on the upwardly facing ledge of the shoulder of said tray support means when the tray is positioned within the cavity, (ii) a securing arm portion extending vertically from the lower edge of said rib member for cooperating with the vertical edge of the lower portion of said shoulder of the tray support means to detachably secure said tray in said cavity, and (iii) a leading arm portion extending horizontally and rearwardly from the securing arm portion, (e) said tray further including positioning means for engaging the inner liner of said door to limit movement of said tray into the cavity, said positioning means cooperating with the downwardly facing surface of said rib member and the vertical edge of the support means to positively locate said tray in the cavity.

2. The assembly of claim 1 wherein the positioning means comprises flanges projecting laterally from the tray for engaging ends of the supporting side walls, said tray support means comprising a shoulder located inwardly of the end of the side wall by an amount substantially equal to the amount the arm means are from the flanges.

3. The assembly of claim 2 wherein the flanges are formed in the side walls of the tray.

4. The assembly of claim 1, wherein the side walls of the tray each have a lip that extends toward the adjacent side wall of the liner.

5. The assembly of claim 4 wherein the tray further includes an upstanding rear wall that is located adjacent the rear wall of the liner and the positioning means comprises a lip that extends toward the rear wall from the liner and integral with the liner.

6. The assembly of claim 1 wherein the tray further includes an upstanding rear wall that is located adjacent the rear wall of the liner and the rear wall having a lip that extends toward the rear wall of the liner for engagement therewith to positively locate the tray in the cavity.

7. The assembly of claim 1 wherein said predetermined angle slopes downwardly with respect to the vertical at an acute angle in the range of 25° to 35°.

8. The assembly of claim 7 wherein said predetermined angle is 30°.

9. The assembly of claim 7 wherein the tray may be pivoted about the tray support means with the securing arm portion resting on the ledge and a lower end portion of the lateral flanges abutting the ends of the support walls.

* * * * *